US005768721A

United States Patent [19]

Kersten

[11] Patent Number: 5,768,721

[45] Date of Patent: Jun. 23, 1998

[54] EMERGENCY SHOWER

[75] Inventor: Steven A. Kersten, Chicago, Ill.

[73] Assignee: Guardian Equipment, Inc., Chicago, Ill.

[21] Appl. No.: 626,039

[22] Filed: Apr. 1, 1996

[51] Int. Cl.[6] ..... A47K 3/22

[52] U.S. Cl. ..... 4/614; 4/612; 4/596; 4/900

[58] Field of Search ..... 4/596, 614, 613, 4/612, 605, 604, 597, 620, 625, 626, 900

[56] References Cited

U.S. PATENT DOCUMENTS

| | | | |
|---|---|---|---|
| 2,315,927 | 4/1943 | Brack . | |
| 2,572,463 | 10/1951 | Fine . | |
| 3,633,223 | 1/1972 | Killias . | |
| 3,864,760 | 2/1975 | Bowen . | |
| 4,064,570 | 12/1977 | Kim . | |
| 4,084,270 | 4/1978 | Kersten . | |
| 4,424,598 | 1/1984 | Cima . | |
| 4,550,570 | 11/1985 | Hanemaayer . | |
| 4,796,311 | 1/1989 | Shankman | 4/596 |
| 5,060,322 | 10/1991 | Delepine | 4/612 |
| 5,070,549 | 12/1991 | Campe | 4/612 |
| 5,157,798 | 10/1992 | Van Kammen . | |
| 5,329,650 | 7/1994 | Zaccai et al. | 4/605 |

*Primary Examiner*—David J. Walczak
*Attorney, Agent, or Firm*—Seyfarth, Shaw, Fairweather & Geraldson

[57] ABSTRACT

An emergency shower apparatus comprising a deluge shower positioned in the vicinity of a wall, a removable access panel, a valve located behind the access panel having an open position and a closed position, and a shower control lever movable between an open position, in which the valve is open, and a closed position, in which the valve is closed, wherein the shower control lever does not project substantially from the wall when the shower control means is in the closed position.

8 Claims, 1 Drawing Sheet

EMERGENCY SHOWER

The present invention relates to an emergency shower and a means for controlling it. More particularly, the present invention relates to a means for activating and controlling an emergency shower that does not project substantially from a wall or ceiling.

BACKGROUND OF THE INVENTION

Emergency showers have long been important safety devices in laboratories and industrial workplaces. A number of different designs for emergency showers are known. All of the designs must satisfy several criteria. First, the means for activating the flow of water must be easy to find and activate in an emergency. Second, the shower must be capable of delivering a high volume of water immediately when the flow of water is activated. And, third, the shower must be capable of delivering a constant flow of water immediately after an extended period of disuse.

To insure easy activation of the shower, traditional emergency shower designs generally have means for activating the flow of water that project a substantial distance from a wall or a ceiling. For example, some designs have large metal rings that hang from the ceiling on a metal pull chain, some have an extended pull rod that hangs from the ceiling, and some have a pull chain or cord that is suspended between the ceiling and a wall. In these designs, the means for controlling the flow of water is easy to locate and activate in an emergency, but it creates a physical hazard or obstruction to those walking or standing in the vicinity, even when the emergency shower is not activated. The physical hazard or obstruction created by the means for activating the flow of water detracts from the overall benefit of the emergency shower and prevents its placement in an easily accessible area with high traffic.

Furthermore, in some of these shower designs, the valve and fittings of the emergency shower are often enclosed in a wall, preventing easy access to them. Maintenance is therefore greatly hampered. Alternatively, the valve and fittings, as well as the pipes, are often exposed. While the designs in which the valve and fittings are exposed provide easy access to the valve and fittings for maintenance, they are unsightly and fail to protect the valve, fittings, and pipes from spills and emissions in the laboratory or industrial workplace near the emergency shower.

It is, therefore, an object of the present invention to provide an emergency shower wherein the means for controlling the flow of water does not project substantially from a wall or ceiling and does not create a physical hazard or obstruction, yet is easy to activate. It is also an object of the present invention to provide an emergency shower wherein the valve and fittings are easily accessible, yet are within a wall to hide them from view and protect them.

SUMMARY OF THE INVENTION

These objects and others are achieved according to the present invention by an emergency shower in which the means for controlling the flow of water does not project substantially from a wall when the flow of water is not activated. However, the means for controlling the flow of water, located substantially between the valve and fittings of the emergency shower and the work area in which the shower is located, is of such a design that it is easily actuated in case of emergency. It is also of such a design that it does not prevent access to the valve and fittings, but permits the valve and fittings to be hidden behind a wall. The shower head of the emergency shower can be mounted on a ceiling, recessed in a ceiling, or it can extend from a wall.

Further objects, features, and advantages of the invention will become evident from a consideration of the following detailed description when taken in conjunction with the accompanying drawings and the appended claims.

BRIEF DESCRIPTION OF THE DRAWINGS

To facilitate an understanding of the invention, a preferred embodiment thereof is illustrated in the accompanying drawings, from an inspection of which, when considered in connection with the following description, its construction, its operation, and many of its advantages should be readily understood and appreciated.

DETAILED DESCRIPTION OF THE PREFERRED EMBODIMENT

Figure 1:
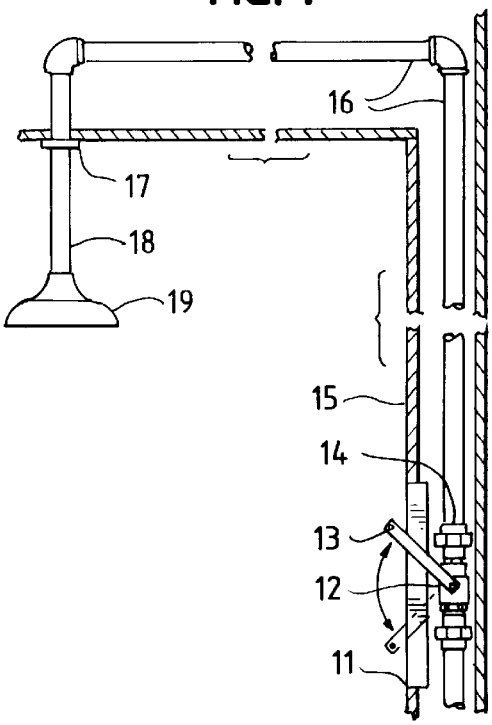
FIG. 1 is an illustration of one preferred embodiment of the present invention from a side view.
Figure 2:
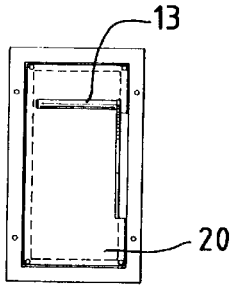
FIG. 2 is an illustration of a portion of one preferred embodiment of the present invention from a front view.
Figure 3:
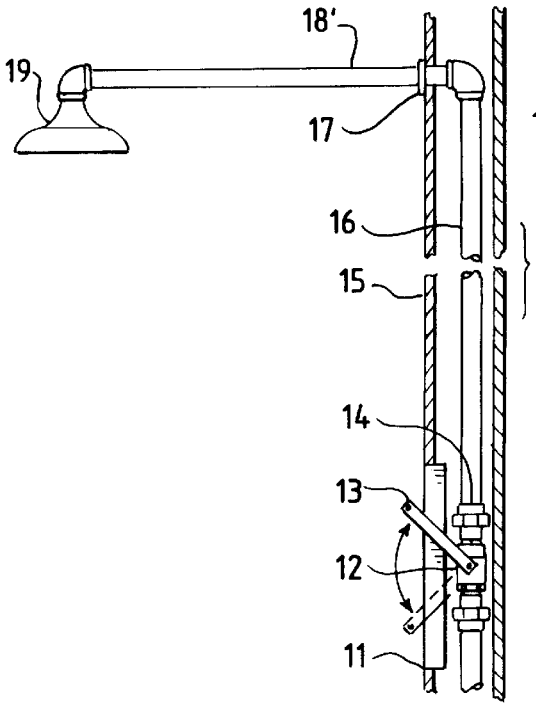
FIG. 3 is an illustration of one preferred embodiment of the present invention from a side view.
Figure 4:
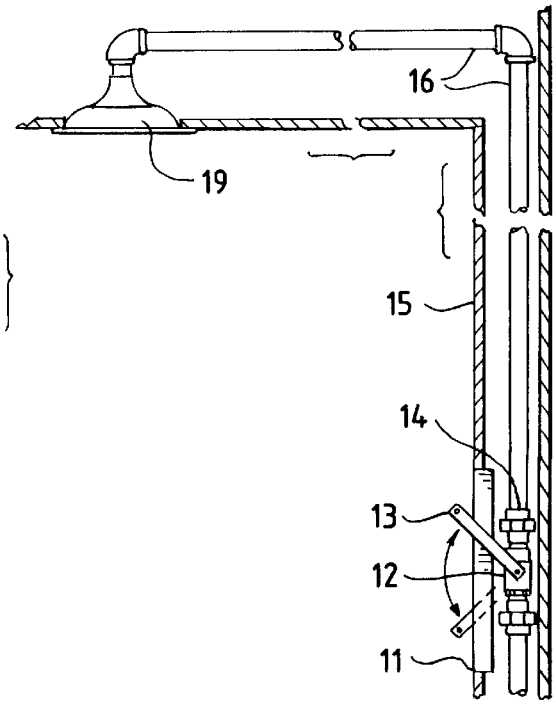
FIG. 4 is an illustration of one preferred embodiment of the present invention from a side view.

FIGS. 1, 2, 3, and 4 illustrate an emergency shower as described and claimed in this application. In a preferred embodiment, as shown in FIGS. 1, 3, and 4, a recessed area 11, approximately between waist-level and eye-level, is provided in a wall 15. Mounted substantially behind the recessed area 11 and within the wall 15 is the valve 12 for the emergency shower. In a preferred embodiment of the emergency shower, the valve is of a stay-open design to ensure continuous water flow through the shower until the valve is manually closed.

The valve 12 is controlled by a shower control mechanism 13 located predominantly in the recessed area 11. The shower control mechanism does not project substantially beyond the wall 15 yet, as shown in FIG. 2, the shower control mechanism 13 is designed to allow it to be grasped and controlled easily in an emergency. For example, the shower control mechanism can be a "panic bar", a lever, a handgrip, or some other design. In one preferred embodiment, the shower control mechanism is a "panic bar" that causes water to flow through the valve when the "panic bar" is rotated from an upper, closed position, as shown in FIG. 1, to a lower, open position, as shown in dotted lines in FIG. 1.

As shown in FIG. 1, 3, and 4, the fittings 14 are also found substantially behind the recessed area 11. The recessed area 11 is configured and the fittings 14 are mounted in such a manner that the fittings are easily accessible for maintenance. The fittings connect the valve 12 to the pipes 16 to allow water that passes through the valve to flow to the deluge shower head 19.

In a preferred embodiment, a removable access panel 20 is mounted in the recessed area behind the shower control mechanism 13. The access panel provides access to the valve 12 and fittings 14 without inhibiting use of the shower control mechanism 13, thus preserving an attractive appearance by hiding the valve and fittings from view when not being maintained.

The deluge shower head 19 is mounted at such a level to permit an individual to stand substantially upright beneath it. When the shower control mechanism 13 is in the open position, water flows through the valve 12 and the fittings 14 to the pipes 16 and out through the deluge shower head 19. The flow of water provides a deluge shower for emergency circumstances.

As shown in FIGS. 1, 3, and 4, many configurations of the emergency shower are possible. For example, depending upon the layout of the work area in which the emergency shower is located and the preference of the user, the pipes 16 and the shower head 19 can be configured several different ways. Among these are a "suspended" design, shown in FIG. 1, in which the pipes 16 are mounted above a suspended ceiling and attached to the deluge shower head 19 which is mounted on a downpipe which projects through the ceiling, a "wall-mounted" design, shown in FIG. 3, in which the pipes 16 and the deluge shower head 19 are within the work area, and a "ceiling-mounted" design, shown in FIG. 4, in which the pipes 16 and the deluge shower head 19 are mounted above a suspended ceiling.

In a preferred embodiment of the suspended design, as shown in FIG. 1, a downpipe 18 is provided to connect the pipes 16 to the deluge shower head 19. The downpipe is held in place against the ceiling by an escutcheon 17. The deluge shower head 19, the downpipe 18, and the escutcheon 17 are all of an attractive design and finish.

In a preferred embodiment of the wall-mounted design, as shown in FIG. 3, a projecting pipe 18' is provided to connect the pipes 16 to the deluge shower head 19. The projecting pipe is held in place against the wall by an escutcheon 17. The deluge shower head 19, the projecting pipe 18, and the escutcheon 17 are all of an attractive design and finish.

In a preferred embodiment of the ceiling-mounted design, as shown in FIG. 4, the deluge shower head 19 is recessed into the ceiling. The deluge shower head is connected to the pipes 16 directly. The deluge shower head is of an attractive design and finish.

The invention has been described above in an illustrative manner and it is to be understood that terminology which has been used is intended to be in the nature of description rather than of limitation. Obviously many modifications and variations of the present invention are possible in light of the above teachings. It is therefore to be understood that within the scope of the appended claims, the invention may be practiced otherwise than as specifically described.

What is claimed is:

1. An emergency shower apparatus for use inside a building comprising:

a wall inside a building;

a recessed area in said wall;

a deluge shower positioned in the vicinity of said wall;

a valve having an open position, in which fluid flows through said valve to said deluge shower, and a closed position, in which fluid does not generally flow through said valve; and a shower control means comprised of a pivoting lever having one end pivotally mounted within said recessed area and a second end extending outwardly from said recessed area wherein said second end can be raised and lowered between an open position, in which said valve is open, and a closed position, in which said valve is closed, wherein said second means does not project substantially from said wall when said shower control means is in the closed position.

2. The apparatus of claim 1, wherein said shower control means is mounted on said wall approximately between waist-level and eye-level.

3. The apparatus of claim 2, wherein said valve is mounted substantially behind said recessed portion of said wall and further comprising a removable access panel that covers the recessed portion of said wall.

4. The apparatus of claim 2, wherein said shower control means is a panic bar.

5. The apparatus of claim 2, wherein said valve control means is a stay-open valve.

6. The apparatus of claim 1, wherein said deluge shower is suspended from a ceiling.

7. The apparatus of claim 1, wherein said deluge shower is recessed in a ceiling.

8. The apparatus of claim 1, wherein said deluge shower extends from a wall.

* * * * *

UNITED STATES PATENT AND TRADEMARK OFFICE

CERTIFICATE OF CORRECTION

PATENT NO. : 5,768,721
DATED : June 28, 1998
INVENTOR(S) : Steven A. Kersten

It is certified that error appears in the above-identified patent and that said Letters Patent is hereby corrected as shown below:

Column 4,
Line 21, delete "means" and insert therefor -- end --

Signed and Sealed this

Thirtieth Day of September, 2003

JAMES E. ROGAN
*Director of the United States Patent and Trademark Office*